United States Patent [19]

Keegan

[11] 4,061,037

[45] Dec. 6, 1977

[54] PIPETTES

[76] Inventor: William P. Keegan, 155 Beach 133rd St., Belle Harbor, N.Y. 11694

[21] Appl. No.: 724,920

[22] Filed: Sept. 20, 1976

[51] Int. Cl.[2] ..... B01L 3/02

[52] U.S. Cl. ..... 73/425.6

[58] Field of Search ..... 73/425.6, 425.4 P

[56] References Cited

U.S. PATENT DOCUMENTS

| | | | |
|---|---|---|---|
| 3,646,817 | 3/1972 | Hinchman | 73/425.6 |
| 3,834,590 | 9/1974 | Robinson | 73/425.6 |

*Primary Examiner*—S. Clement Swisher

[57] ABSTRACT

A mechanical pipette having a measuring piston that controls the volume of liquid drawn into the pipette reservoir and a substantially larger piston that assures that all of the liquid in the reservoir is expelled therefrom on a discharge stroke. On the discharge stroke, a valve is opened to admit air being compressed by the larger piston into the reservoir. Means are provided to adjust the displacement of the larger piston so as to control the pressure developed by the larger piston.

11 Claims, 4 Drawing Figures

PIPETTES

FIELD OF THE INVENTION

The present invention relates to pipettes, and especially to pipettes having means to assure that the volume of liquid aspirated into a reservoir is entirely discharged from the reservoir. More particularly, the invention relates to a pipette having a first measuring piston that determines the volume of liquid drawn into the pipette reservoir, and a second piston having a diameter substantially larger than that of the measuring piston, which second piston compresses a large volume of air that is directed to the reservoir to assure the expulsion of all the liquid therein.

BACKGROUND OF THE INVENTION

The utility of many laboratory procedures requires the precise measurement of a small volume of liquid. It is not uncommon to require the accurate dispensing of volumes of less than 10 milliliters. Even for larger volumes, it is desirable that the accuracy of the measurement be assured and that it be repeatable over many pipetting operations. The design of manual pipettes generally assures that a precise predetermined volume of liquid is aspirated into the pipette reservoir, but the discharge of that precise volume is not always achieved. Quite often, a small quantity of the liquid remains after the discharge stroke of the piston is completed. And unless all of the liquid is discharged from the reservoir, the precision built into the pipette mechanism is negated. The liquid remaining may be a droplet formed at the orifice of the reservoir which is not discharged with the rest of the liquid, or it may be a thin film of liquid adhering to the wall of the reservoir. This often results because the liquid to be expelled is not driven out of the reservoir directly by the pipette piston but by a column of air located between the liquid and the piston. The column of air generally will compress and then expand to drive the liquid out of the reservoir depending on the velocity that the technician imparts to the piston during the discharge stroke (which velocity, of course, can vary from stroke to stroke), the density of the liquid being pipetted, and its viscosity. The latter two factors affect the force necessary to move the liquid from its position of rest in the reservoir.

It will be appreciated that the complete discharge of liquids from pipette reservoirs is important in the use of pipettes for critical laboratory procedures. This is especially true where small volumes, in the order of 10 milliliters or less, are being measured. In such cases, the volume of a droplet remaining on a pipette tip will be an appreciable part of the volume initially aspirated. So much so has this become a consideration that many pipette arrangements have been disclosed that will expell essentially all of the liquid initially drawn into the pipette. The more recent proposals have resorted to the provision of a so-called overblow piston that provides a relatively large quantity of compressed air to blow the liquid residue from the pipette reservoir. See, for example, U.S. Pat. Nos. 3,834,590; 3,933,048; and 3,935,734.

While the pipettes disclosed in the aforementioned patents function as intended, they are subject to the limitation that their discharge operating characteristics are determined by the manufacturing specification, and that these characteristics cannot be altered or adjusted by the technician using the pipette even though they should be altered to take into account the density or the viscosity of the liquid being pipetted. Since different liquids are pipetted from time to time, it would be desirable to have a pipette which embodies an adjustable discharge mechanism.

BRIEF DESCRIPTION OF THE INVENTION

Accordingly, it is the object of the present invention to provide and improved pipette having an adjustable liquid discharge mechanism.

In carrying out the invention, there is provided a pipette having a fixed plunger stroke for both filling and discharging the pipette. The filling stroke aspirates a predetermined volume of liquid into the pipette reservoir by moving a measuring piston between two limiting positions in a small volume air chamber. The volume of liquid aspirated depends on the cross-sectional area and the measuring stroke of the piston. The discharge stroke provides, in addition to the air trapped in the small volume air chamber, a large quantity of air from a second air chamber which assists in blowing the aspirated liquid from the pipette reservoir. The air in the second air chamber is compressed by an overblow piston that has an area substantially larger than the area of the measuring piston and which is displaced by movement of the plunger rod that reciprocates the measuring piston. The overblow piston is returned to a predetermined position by the plunger rod as the latter is restored to the position it takes prior to a discharge stroke. During the discharge stroke of the plunger rod, the rod initially will move relative to the overblow piston and at some point during its stroke the rod, or an appurtenance to the rod, will engage the overblow piston and move it to compress the air in the second air chamber. The mechanism that engages the overblow piston during the discharge stroke is adjustably set with respect to the predetermined position initially occupied by the overblow piston. Thus, the distance the overblow piston moves during the discharge stroke is controlled, and with it the degree of air compression effected by the piston. The arrangement is such that the adjusting mechanism may be set so that the overblow piston will not be engaged during the discharge stroke with the result that the overblow feature may be obviated by the technician if that result is desired for a particular reason.

Features and advantages of the invention may be gained from the foregoing and from the description of a preferred embodiment of the invention that follows.

DETAILED DESCRIPTION OF THE INVENTION

Figure 1:
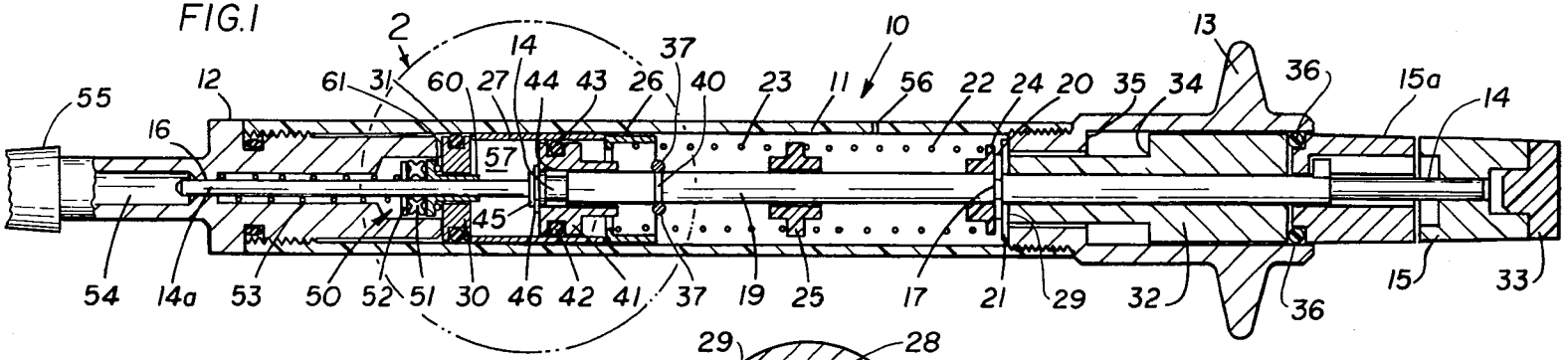
FIG. 1 is a side elevational view, in section, of a pipette embodying the present invention.
Figure 3:
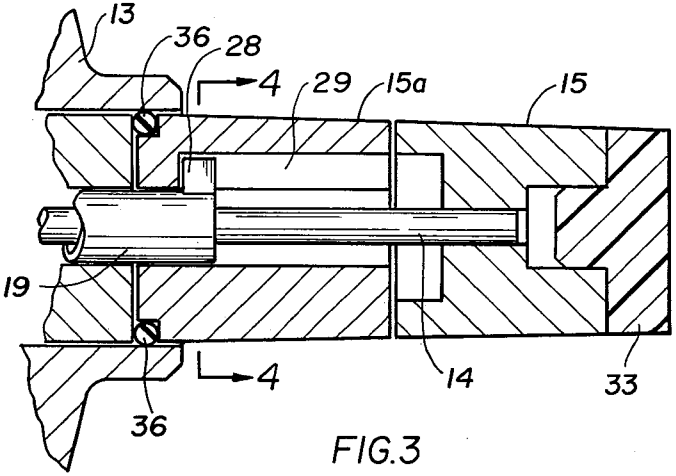
FIG. 3 is an enlarged fragmentary view, in section, of the adjusting mechanism of the pipette.
Figure 4:
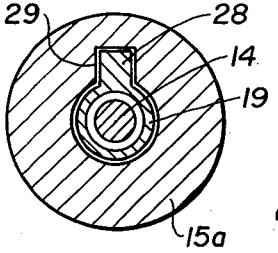
FIG. 4 is a cross-sectional view taken along line 4—4 of FIG. 3.
Figure 2:
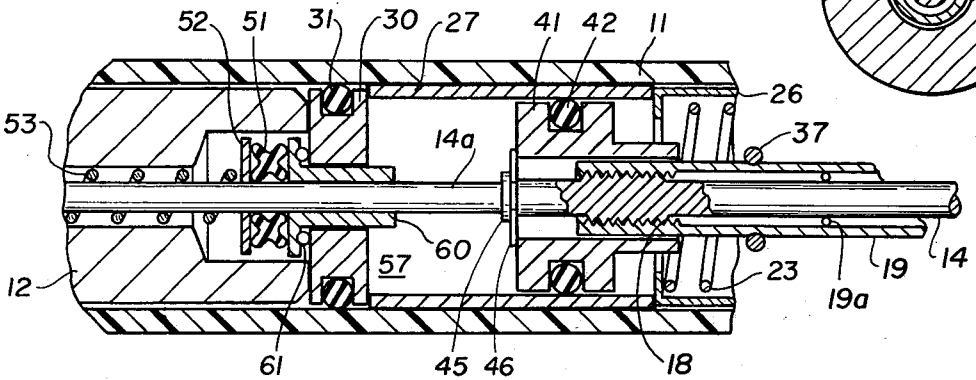
FIG. 2 is an enlarged fragmentary view, in section, of that part of the pipette shown within the dash-dot circle "2" of FIG. 1.

Reference is now made to FIG. 1 which illustrates the preferred embodiment of the invention. The pipette 10 comprises basically a tubular barrel 11, the forward or bottom end of which is internally threaded to accommodate a nozzle member 12. The opposite end of barrel 11 also is internally threaded so that a terminal member 13, which is externally threaded as shown, can be connected securely to the barrel. A plunger rod 14 is shown with a measuring piston 14*a* formed at its forward end. Displacement of rod 14 and piston 14*a* causes the drawing of the liquid being pipetted into the nozzle member 12 or preferably into a disposable tip press fitted onto the nozzle member. At its other end, rod 14 is shown extending to a plunger knob 15 slideably positioned at the extreme end of terminal member 13. In broad principle, depression of knob 15, rod 14, and piston 14*a* (i.e., movement thereof to the left in the drawing) expels a quantity of air from nozzle member 12 so that when the knob 15 is returned to its normal position, as by a biasing spring as will be described hereinafter, a like quantity of liquid, into which the nozzle member or a disposable tip placed thereon is inserted, will be aspirated into the nozzle member or tip. A disposable tip is preferably used so that it is inserted into the liquid and the liquid is drawn up into the tip only. In this way the pipette itself is never touched by the liquid, and thus can never be contaminated thereby, or cause cross-contamination when different samples, especially of biological fluids, are being pipetted.

At its forward end, piston 14*a* is guided in nozzle member 12 by the annular guide ring 16 formed internally in member 12. The guide ring does not form an air tight seal around piston 14*a*, but rather permits air to pass freely between it and the piston. The reason for this will be made clear hereinafter.

Rod 14 is provided with a threaded portion 18 so that an internally threaded elongated hollow cylindrical sleeve member 19 can be joined to the rod and be reciprocated with it. The purpose of member 19 will be considered at a later part of this description but, for the present, it will suffice to note that member 19 can be positioned axially with respect to rod 14 by rotating one relative to the other, and that when so positioned the two move as a unit in the axial direction. The threaded connection between rod 14 and member 19 should be air tight, but to be certain that there is no air passageway between the two members, an "O" ring 19*a* can be used to provide an air tight seal.

Towards its other end where it initially passes through member 13, member 19 is provided with a groove 17 into which fits a snap washer 20. A bearing washer 21 is placed between snap washer 20 and the end surface of member 13, which surface forms a fixed stop that establishes one extreme of travel of member 19, rod 14, and piston 14*a*. Spring means comprising compression springs 22 and 23 bias member 19, rod 14, and piston 14*a* to a position illustrated which is determined by the location of groove 17 and washer 20 along member 19. While one spring, e.g., 22, could have been used instead of the two shown, the latter arrangement is preferred since a single spring would have a tendency to bow when being compressed and rub against the barrel 11 or member 19 to cause a squeaking sound. Springs 22 and 23 bear against nylon bushings 24 and 25, which fit loosely over member 19, and against a flanged cylinder 26. The cylinder in turn bears against tube 27 and the tube against the circumferentially grooved disk 30. An "O" ring 31 is mounted in the groove of disk 30, the disk itself being provided with a central aperture through which rod 14 passes with ample clearance. In fact the central aperture is sufficiently large that another member, to be described later, can be fitted between rod 14 and disk 30.

Within member 13, rod 14 and member 19 pass through a metering block 32 which is restrained against lengthwise travel along member 19 by its engagement with washer 21 and member 15*a*, which in turn abuts knob 15, the latter of which is threaded or force fitted on rod 14 until block 32 is moved into abutting relationship with washer 21. A button 33, which may be of a plastic material and color coded to indicate the volumetric capacity of the pipette, may be provided on knob 15. Barrel 11 may also be of a plastic material and color coded for the same purpose. An "O" ring 36 serves as a low friction bearing member for guiding knob 15 along the bore of member 13, but it does not make an air tight seal between knob 15 and member 13.

Member 15*a* is provided to enable rod 14 and sleeve member 19 to be rotated relatively to each other so that their axial relationship can be adjusted. This is accomplished by the provision of an abutment or lug 28 secured to member 19 which is fitted into the keyway 29 formed in member 15*a*. With this arrangement, as knob 15 (and rod 14) is held securely and member 15*a* rotated, or vice versa, sleeve member 19 will be moved longitudinally with respect to rod 14. The purpose of this relative longitudinal movement will be explained hereinafter. While the drawing shows small spacings between block 32 and member 15*a*, between member 15*a* and knob 15, it is to be understood that this is for purposes of illustration only; the parts will be in abutting relationship. Since member 15*a* will be rotated with respect to block 32 and knob 15 when abutting these two members, it might be preferred to form member 15*a* of Teflon, or some similar low friction material, to facilitate such rotation. In such case, "O" ring 36 could be eliminated.

It will be clear from the description so far that rod 14 will be in the one limiting position illustrated by the action of springs 22 and 23. When the rod is depressed, as by pressure on knob 15, it will move until the end 34 of the wider diameter portion of block 32 strikes the shoulder 35 formed on the inside of member 13. Thus, the volumetric capacity of the pipette will be determined by the cross sectional area of measuring piston 14*a* and the length of the stroke of the piston. The latter is determined by the engagement of the end 34 of block 32 with shoulder 35, and the engagement of snap washer 20 and bearing washer 21 with the inside end 29 of member 13. As will be explained hereinafter, due to the construction of the pipette embodiment being described, the effective aspirating stroke of measuring piston 14*a* will be slightly less than that just indicated. But, since the difference between the total stroke and the effective stroke will be known and fixed, compensation can be made so that the pipette aspirates the exact predetermined volume of liquid desired. To vary the capacity of the pipette, a different block (not shown) would be used, the different block having the same overall length as block 32 but having a wider diameter portion of shorter or longer length. In this way a different length stroke for piston 14*a* would be provided. Or alternatively, the position of groove 17 and washer 20 could be changed.

Attention is now directed to those components of the pipette which assure that all of the liquid aspirated into the pipette reservoir will be expelled during a discharge operation. A sealing ring 37 is positioned in annular groove 40 formed on the circumference of member 19. Spaced a short distance along member 19 from ring 37 is the overblow piston 41. However, since member 19 can be axially positioned relative to rod 14 (which together with washers 45 and 46 determine the position of piston 41 initially) as previously described, the distance between ring 37 and piston 41 can be varied. Piston 41 is formed with an annular groove 42 which receives an "O" ring 43 that provides an air tight seal between the piston and the bore of barrel 11, which in the present construction is tube 27 along which piston 41 slides. Overblow piston 41 is provided with an axial bore 44 through which member 19 can pass with sufficient clearance to allow air to flow freely from one end of the piston to the other through the bore. A snap ring washer 45 on rod 14 and washer 46 bear against piston 41 and move it to the right (as viewed in the drawing) to the position shown. Thus, the location of washer 45 on rod 14 determines the initial or starting position of piston 41. Piston 41 is moved to the left when engaged by seal ring 37, and therefore the stroke of the piston is determined by the separation between washer 45 on rod 14 and seal ring 37 on member 19.

A valve 50 in the form of a quad ring 51, washer 52, compression spring 53, flanged hollow tube 60, and sealing ring 61 is provided between piston **14*a* and disk 30. Spring 53 is a relatively light spring, the only purpose of which is to cause quad ring 51 and sealing ring 61 to make an air tight seal between piston 14*a* and disk 30. However, the spring is weak enough to permit very little axial force on tube 60 to compress it and thus open valve 50 and allow air from chamber 57 to flow between disk 30 and piston 14*a* and out nozzle member 12**.

Having thus described the construction of the pipette, its operation will now be considered. Knob 15 is depressed until end 34 and block 32 strikes shoulder 35 thus driving piston **14*a* down into chamber 54 to supplant a predetermined volume of air. The tip of the pipette 10 or preferably a disposable tip 55 mounted on nozzle member 12 is then inserted into the liquid being pipetted. Pressure on knob 15 is released and springs 22 and 23 move rod 14 and member 19 to the right until washer 21 strikes the end of member 13. As piston 14*a* moves to the right, liquid is aspirated into pipetted tip 55. During the initial rightward movement of rod 14, valve 50 will be open and it will not close until rod 14 moves a distance equal to that which tube 60 was translated during the leftward travel of rod 14. It is this incremental distance, which is very small since valve 50 only has to be opened a crack to allow compressed air in chamber 57 to pass through the central aperture of disk 30 into chamber 54, that rod 14 must travel prior to the closing of valve 50 which must be compensated for in establishing the effective aspirating stroke of rod 14. In other words, the effective aspirating stroke of rod 14 is equal to the stroke as determined by the stops of member 13, i.e., end 29 and shoulder 35, less the distance which tube 60 is translated at the terminal end of a leftward stroke of rod 14. Also, during the initial movement of rod 14 from its leftmost position, piston 41 does not move since it must first be engaged by washers 45 and 46. The washers had moved away from the piston 41 during the initial leftward movement of rod 14, and the piston itself had not moved until engaged by seal ring 37. During the relative movement between rod 14 and piston 41 which brings washer 46 into engagement with piston 41, seal ring 37 is moving away from the opposite end of piston 41 to the relative position shown in the drawing. Rod 14 and piston 41 continue their rightward movement in engagement until such time as washer 21 engages the end of member 13. At the end of the rightward movement of rod 14, the parts of the pipette will be as illustrated and a predetermined volume of liquid will be in the tip 55**.

The interior of the pipette to the right of disk 30 will contain air at atmospheric pressure since that portion of the pipette to the right of "O" ring 31 and valve 50 is not of air tight construction. In fact, a small aperture 56 could be provided in barrel 11 to assure that air does leak into the interior of the pipette. Note especially that piston 41 is spaced from seal ring 37 so that air will leak past ring 37 and through bore 44 of piston 41 to the air chamber 57 between disk 30 and piston 41. Note also that valve 50 prevents any air leakage around measuring piston **14*a***.

To discharge the aspirated liquid from pipette tip 55, knob 15 is again depressed. Initially, piston 41 does not move because of its free fit on member 19 and because of the snug air tight engagement with the internal wall of tube 27 provided by "O" ring 43. Thus, during the initial movement of rod 14, washer 45 moves away from the left hand end of piston 41. However, as rod 14 continues its movement to the left, seal ring 37 engages the right hand end of piston 41 and, thereafter, piston 41 will move leftward along with rod 14. Chamber 57 is sealed once seal ring 37 engages piston 41 and air pressure therein builds up as the volume of the chamber is decreased by the leftward movement of piston 41. At a position in the leftward movement of rod 14, just prior to such movement being arrested by the engagement of end 34 of block 32 with shoulder 35, washer 45 engages the end of tube 60 so that additional movement of rod 14 opens valve 50 and allows the compressed air in chamber 57 to expand into chamber 54 and expel the liquid in tip 55. The distance between washer 45 and disk 30 is related to the distance between end 34 of block 32 and shoulder 35.

It will be clear at this point that the degree of air compression effected by overblow piston 41 will be determined by the longitudinal movement of piston 41 and this will, in turn, be determined by the initial spacing of seal ring 37 from the end of piston 41. Piston 41 is brought to a fixed position by washer 45 on the return stroke of rod 14. Since rod 14 (and member 19 and seal ring 37) travels a fixed distance during each stroke, it follows that if seal ring 37 is spaced a greater distance from piston 41 it will travel a greater distance before it engages piston 41 to seal air chamber 57 and it will travel, and move piston 41, a shorter distance for the remainder of the stroke of rod 14. Thus, since piston 41 travels a short distance, the air in chamber 57 undergoes a slight compression and a minimal blow out effect is achieved. As an extreme example, it might be envisioned that a technician wishes to eliminate the blow out feature for some special reason. In such a case, sleeve member 19 would be rotated relative to rod 14 to position seal ring a distance from piston 41 greater than the stroke of rod 14. Hence piston 41 would not be engaged by seal ring 37 and there would be no compression of air in chamber 57. On the other hand, seal ring 37 could initially be positioned close to piston 41 so that it quickly engages the piston and moves it a comparatively long distance thereby effecting a greater compression of air in chamber 57. It is clear that the disclosed arrangement permits a wide range of air compressions in chamber 57 simply by rotating rod 14 relative to member 19 to change the spacing between washer 45 and seal ring 37. Thus, an optimum blow out effect can be attained for all liquids being pipetted regardless of their viscosity or density.

Having thus described the invention, it is clear that many apparently widely different embodiments thereof could be provided without departing from its spirit and scope. The general principles of the invention could be embodied in other overblow pipettes such, for example, as those disclosed in aforementioned U.S. Pat. Nos. 3,834,590 and 3,933,048, or resort may be had to yet other pipette configurations. The pipette could be configured so that by depressing the thumb knob liquid is aspirated into the pipette or tip, and by releasing the knob the liquid is expelled. Of course, whether or not a disposable tip is used is optional with the user, and will generally depend on the use to which the pipette is put. The invention could also be used in automatic or power actuated pipettes in which the pistons are moved by power driven cams, or the like, rather than in manual pipettes as described. Therefore, it is intended that the specification and the drawing be interpreted as illustrative rather than in a limiting sense.

What is claimed is:

1. A pipette comprising an overblow piston having a longitudinal aperture therein, plunger rod means extending through the aperture in said overblow piston in a non-airtight relationship, means for reciprocating said rod means with respect to said piston, washer means mounted on said rod means for engaging said piston to move it to a fixed position, sealing means mounted on said rod means for movement into engagement with said piston to form an airtight relationship between said rod means and said piston and for moving said piston away from its fixed position, and means for adjusting the spacing between said washer means and said sealing means whereby the distance moved by said piston from its fixed position is adjustable.

2. A pipette according to claim 1 wherein said overblow piston compresses air in an air chamber when moved by said sealing means, and including a measuring piston movable in a second air chamber to aspirate liquid into a liquid reservoir, and valve means for controlling the flow of air from said air chamber to said second air chamber.

3. A pipette according to claim 2 wherein said measuring piston is directly connected to said plunger rod means.

4. A pipette according to claim 2 wherein said valve means is a spring biased check valve and said valve is opened when engaged by said washer means.

5. A pipette according to claim 1 wherein said plunger rod means comprises a rod and a sleeve member movable along said rod, and wherein said washer means is mounted on said rod and said sealing means is mounted on said sleeve member.

6. A pipette according to claim 5 wherein said rod and said sleeve member are each provided with threaded portions in threaded relationship with each other whereby said sleeve member is moved along said rod by rotating the rod or the sleeve member relatively to the other.

7. A pipette according to claim 6 wherein said sleeve member is provided with a lug, and including a rotatable adjusting collar having an elongated slot into which said lug projects.

8. A pipette comprising, hollow housing means having a nozzle end and a remote end, means dividing the interior of said housing means into a first air chamber and a second air chamber, said dividing means having an air passageway connecting said first and said second air chambers, normally closed valve means for admitting air from said second air chamber into said first air chamber, a measuring piston movable in said first air chamber for aspirating a predetermined volume of liquid into a liquid reservoir, an overblow piston movable in said second air chamber for compressing air in said chamber, plunger means connected to said measuring piston and extending out of the remote end of said housing means, means biasing said plunger means to one limiting position, first means connected to said plunger means for engaging said overblow piston to move it to a first position wherein said second air chamber is vented to the outside of said housing means, second means for sealing said second air chamber and for engaging said overblow piston to move it in an air compressing direction to a second position, said second means being adjustably connected to said plunger means, and means external to said housing means for adjusting the position of said second means relative to said plunger means whereby the point at which said overblow piston is engaged by said second means can be varied and the stroke of said overblow piston thereby adjusted to control the degree of air compression in said second air chamber.

9. A pipette according to claim 8 wherein said second means comprises a sleeve member that is longitudinally positioned along said plunger means to adjust the point in the stroke of said plunger means at which the overblow piston is engaged and a sealing member that seals said second air chamber when said plunger means is moved away from its limiting position.

10. A pipette according to claim 9 wherein said sleeve member is threadedly connected to said plunger means and is provided with an outwardly projecting lug member, and wherein said adjusting means is a cylindrical member rotatable relative to said plunger means and having an internal longitudinal slot into which said lug member projects for rotating said sleeve member relative to said plunger means.

11. A pipette according to claim 9 wherein said sealing member is fixedly located on said sleeve member and engages said overblow piston to move it in an air compressing direction.

* * * * *